US009440367B2

(12) United States Patent
Zakuskin

(10) Patent No.: US 9,440,367 B2
(45) Date of Patent: Sep. 13, 2016

(54) DEVICE FOR WET SHAVING

(75) Inventor: Yuriy Zakuskin, Orekhov (UA)

(73) Assignee: OAK Novations, Ltd., Middlesex, NJ (US)

( * ) Notice: Subject to any disclaimer, the term of this patent is extended or adjusted under 35 U.S.C. 154(b) by 311 days.

(21) Appl. No.: 13/221,905

(22) Filed: Aug. 31, 2011

(65) Prior Publication Data

US 2013/0047449 A1 Feb. 28, 2013

(51) Int. Cl.
*B26B 21/52* (2006.01)

(52) U.S. Cl.
CPC ..... *B26B 21/521* (2013.01); *B26B 21/52* (2013.01)

(58) Field of Classification Search
CPC .... B26B 21/52; B26B 21/521; B26B 21/522
USPC ..... 30/526, 329–331, 337–339
See application file for complete search history.

(56) References Cited

U.S. PATENT DOCUMENTS 387,359 A * 8/1888 Kampfe ..... 30/526
471,070 A * 3/1892 Scharff ..... B26B 21/52 30/64
778,388 A * 12/1904 Warren ..... 30/526
851,341 A * 4/1907 Bullard ..... 30/526
936,654 A * 10/1909 McIntire ..... 30/526
977,919 A * 12/1910 Yeaton, Jr. ..... 30/526
999,483 A * 8/1911 Brown ..... 30/526
1,014,431 A * 1/1912 Adler ..... 30/526
1,049,031 A * 12/1912 Adler ..... 30/526
1,053,089 A * 2/1913 En Holm ..... 30/526
1,111,721 A * 9/1914 Gillette ..... 30/526
1,125,328 A * 1/1915 Howard ..... 30/526
1,234,834 A * 7/1917 Warren ..... B26B 21/52 30/47
1,378,079 A * 5/1921 Williamson ..... 30/526
1,529,309 A * 3/1925 Hoegberg ..... 30/338
1,534,310 A * 4/1925 Gaunt ..... 30/338
1,558,021 A * 10/1925 Libi ..... 30/526
1,675,128 A * 6/1928 Ostrovsky ..... B26B 21/52 30/531
1,753,459 A * 4/1930 Gaffney ..... 30/338
1,756,639 A * 4/1930 Greene ..... 30/526
1,978,857 A * 10/1934 Chalmers ..... 30/339
1,999,200 A * 4/1935 Nagy ..... B26B 21/52 30/531
2,156,559 A * 5/1939 Young et al. ..... 30/526
2,172,680 A * 9/1939 Noreau, Jr. ..... 30/338
2,366,445 A * 1/1945 Feldman ..... 30/526
2,386,536 A * 10/1945 Bensel ..... B26B 21/52 30/77
2,583,057 A * 1/1952 Leatherman ..... 30/526
2,588,211 A * 3/1952 Crowell ..... 30/526

(Continued)

FOREIGN PATENT DOCUMENTS

CA 2356571 A1 * 4/2002
DE 468611 C * 11/1928

(Continued)

*Primary Examiner* — Jason Daniel Prone
(74) *Attorney, Agent, or Firm* — Cygnet IP Law, P.A.; Stephen W. Aycock, II

(57) ABSTRACT

A razor suitable for providing a wet shave razor includes: a spring-action razor handle, the razor handle having a U-shaped spring section; two transition arms, each transition arm extending from a respective end of the U-shaped spring section; two blade retention clamps, each blade retention clamp extending from a respective one of the transition arms; and at least one razor blade configured for retention by the blade retention clamps, the spring action razor handle functioning to maintain at least one razor blade in a state of tension.

13 Claims, 7 Drawing Sheets

(56) References Cited

U.S. PATENT DOCUMENTS

| | | | | | |
|---|---|---|---|---|---|
| 2,599,193 | A * | 6/1952 | Morris | | 30/339 |
| 2,634,498 | A * | 4/1953 | Abrahamsen | | 30/339 |
| 2,648,129 | A * | 8/1953 | Streeter | B26B 21/18 | 30/526 |
| 2,720,697 | A * | 10/1955 | Duncan | | 30/526 |
| 3,015,159 | A * | 1/1962 | De Braun | | 30/526 |
| 3,201,867 | A * | 8/1965 | Case | | 30/339 |
| 4,392,303 | A * | 7/1983 | Ciaffone | B26B 21/521 | 30/526 |
| 4,428,116 | A * | 1/1984 | Chen et al. | | 30/532 |
| 4,459,744 | A * | 7/1984 | Esnard | | 30/49 |
| 4,797,998 | A * | 1/1989 | Motta | | 30/530 |
| 5,062,210 | A * | 11/1991 | Arroyo, Jr. | | 30/339 |
| 5,084,978 | A * | 2/1992 | McReynolds | | 30/338 |
| 5,157,834 | A * | 10/1992 | Chen | B26B 21/225 | 30/532 |
| 6,871,403 | B2 * | 3/2005 | Clark | | 30/51 |
| 8,166,661 | B2 * | 5/2012 | King | | 30/527 |
| 2009/0038167 | A1 * | 2/2009 | Peyser et al. | | 30/527 |
| 2010/0269352 | A1 * | 10/2010 | Curtin | | 30/337 |
| 2012/0233868 | A1 * | 9/2012 | Bridges et al. | | 30/526 |
| 2012/0297625 | A1 * | 11/2012 | Madden | | 30/42 |
| 2014/0109735 | A1 * | 4/2014 | Shepperson | B26B 21/521 | 30/527 |
| 2015/0075012 | A1 * | 3/2015 | Opinel | A47J 17/02 | 30/295 |
| 2015/0183119 | A1 * | 7/2015 | Contaldi | B26B 21/522 | 30/50 |
| 2016/0129604 | A1 * | 5/2016 | Zakuskin | B26B 21/521 | 30/526 |

FOREIGN PATENT DOCUMENTS

| | | | | |
|---|---|---|---|---|
| DE | 633170 | C | * | 7/1936 |
| DE | 800068 | C | * | 8/1950 |
| FR | 702939 | A | * | 4/1931 |
| FR | 806899 | A | * | 12/1936 |
| FR | 2363411 | A1 | * | 3/1978 |
| FR | 2471259 | A1 | * | 6/1981 |
| GB | 191203936 | A | * | 0/1913 |
| GB | 257754 | A | * | 9/1926 |
| GB | 369775 | A | * | 3/1932 |
| WO | WO 2013033036 | A1 | * | 3/2013 |

* cited by examiner

DEVICE FOR WET SHAVING

FIELD OF THE INVENTION

This invention relates to wet shaving devices and, in particular, to a razor having a handle configuration retaining a shaving blade by tension means.

BACKGROUND OF THE INVENTION

Many various types of wet shaving devices are known in the relevant art. Most devices in widespread use include a shaving cartridge that is difficult to clean and may thus not be readily reusable. Accordingly, the razor may be disposed of by the user after only a single use. By not being able to reuse such a razor blade, the shaver finds that a potential cost savings is lost.

What is needed is a device that provides better blade cleaning during and after the shaving, as well as a better shaving experience, and allows for more than a single use.

BRIEF SUMMARY OF THE INVENTION

In one aspect of the present invention, a razor suitable for providing a wet shave razor comprises: a spring-action razor handle, the razor handle including a U-shaped spring section; two transition arms, each transition arm extending from a respective end of the U-shaped spring section; two blade retention clamps, each blade retention clamp extending from a respective one of the transition arms; and at least one razor blade configured for retention by the blade retention clamps, the spring action razor handle functioning to engage and maintain at least one razor blade in a state of tension.

In another aspect of the present invention, a razor handle suitable for securing at least one razor blade comprises: a spring-action razor handle, the razor handle including a U-shaped spring section; two transition arms, each transition arm extending from a respective end of the U-shaped spring section; and two blade retention clamps, each blade retention clamp extending from a respective one of the transition arms, each blade retention clamp including at least one groove for securing at least one razor blade whereby the razor handle maintains a state of compression so as to place at least one razor blade into a state of tension.

In another aspect of the present invention, a method for providing a wet shave comprising: obtaining a pair of blade retainer clamps, the blade retainer clamps attached to a spring-action razor handle; and, installing a razor blade onto the blade retainer clamps such that the spring-action razor handle is placed into a state of compression and thereby functions to maintain the razor blade in a state of tension.

The additional features and advantage of the disclosed invention is set forth in the detailed description which follows, and will be apparent to those skilled in the art from the description or recognized by practicing the invention as described, together with the claims and appended drawings.

BRIEF DESCRIPTIONS OF THE DRAWINGS

The foregoing aspects, uses, and advantages of the present invention will be more fully appreciated as the same becomes better understood from the following detailed description of the present invention when viewed in conjunction with the accompanying drawings, in which.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims. Those skilled in the art will appreciate that the conception upon which the disclosure below is based may readily be utilized as a basis for designing other similar products. For example, wet shaving devices as disclosed and claimed are not limited to the materials described herein, and the size, shape, and features of the handle and blade components can be modified without departing from the spirit of the invention.

The innovative shaving device is a new and safe razor. The razor uses a novel method of blade retention, based on a principle of the placing the shaving blade into a state of tension. The body of the razor functions as a user handle and simultaneously places the razor blade in tension. With this approach, the razor blade has the best access to the surface of the face of the razor user. This system makes it possible to save on the materials for the blades, since the novel razor blades have a relatively smaller surface area, and require less material for fabrication, than most conventional shaving blades and shaving blade cartridges.

Figure 1:
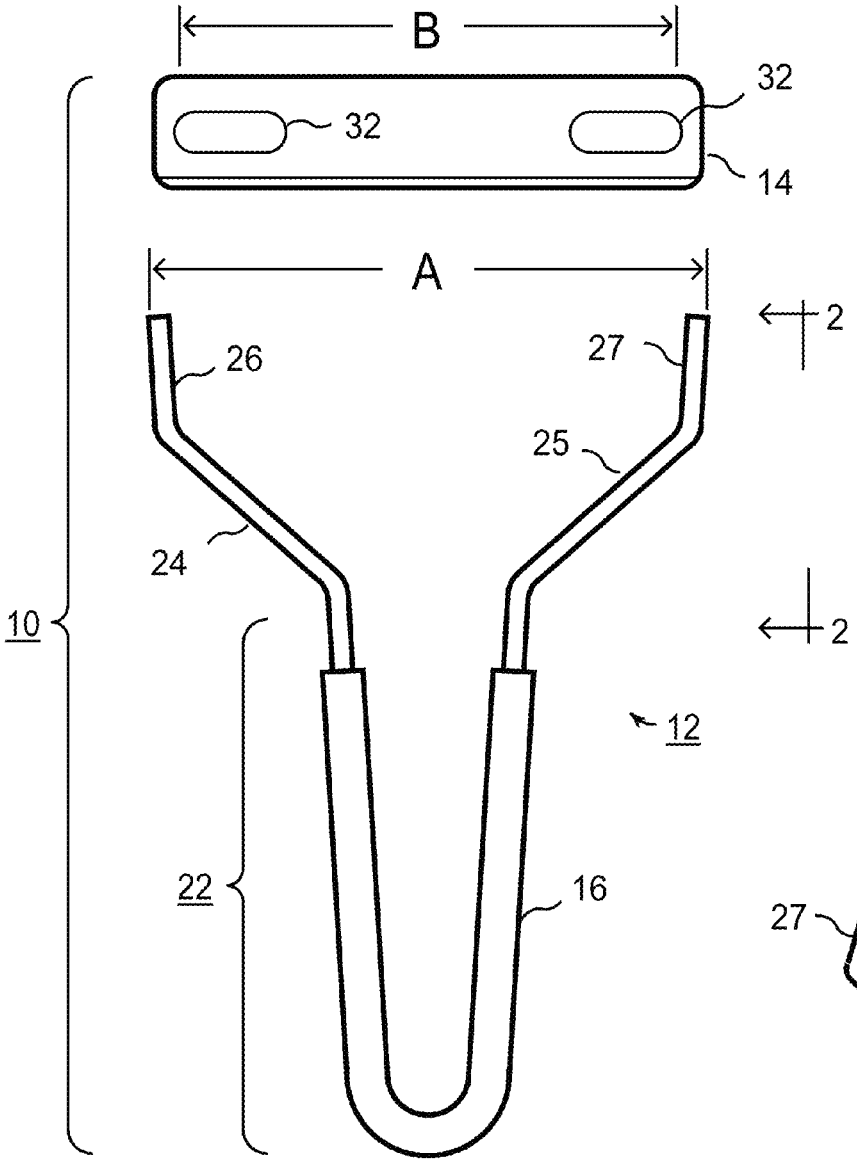
FIG. 1 is an exploded view of a razor including a spring-action handle with a razor blade, in accordance with the present invention.

There is shown in FIG. 1 an exploded view of an exemplary embodiment of a razor 10 comprising a spring-action razor handle 12 (front view shown) and a razor blade 14 (top view shown), in accordance with the present invention. In an exemplary embodiment, the razor blade 14 may have a length of about 45 mm and a width of about 7.0 mm. The spring-action razor handle 12 includes a handle sleeve 16 fabricated from a pliable or soft material, such as a plastic, rubber, or corrugated cambric tube, and disposed on a handle frame 18. The handle frame 18 may be fabricated from a cylindrical metal or plastic material and includes: (i) a U-shaped spring section 22, (ii) transition arms 24, 25 extending from respective ends of the U-shaped spring section 22, and (iii) blade retainer clamps 26, 27 extending from respective transition arms 24, 25. It can be appreciated by one skilled in the art that the U-shaped spring section 22 and the transition arms 24, 25 form a substantially Y-shape configuration and allows for the spring-action razor handle 12 to engage with and retain the razor blade 14.

Figure 2:
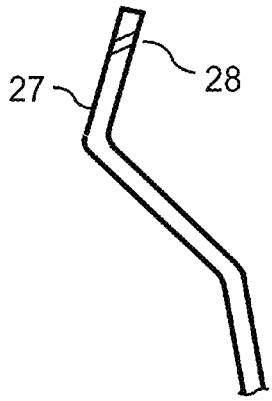
FIG. 2 is a partial side view of the razor of FIG. 1.

The U-shaped spring section 22 is configured to function as a clamp spring that can be placed into a state of compression by gripping and squeezing. At clamp spring "equilibrium," the U-shaped spring section 22 normally positions and maintains the tip of the blade retainer clamp 26 at a predetermined distance from the tip of the blade retainer clamp 27, as indicated by dimension "A." The dimension "A" is preferably greater than a dimension "B" between the outer edges of slots 32 in the razor blade 14. The blade retainer clamps 26, 27 each include a groove 28, as shown in FIG. 2, each groove 28 configured to receive and engage a respective slot 32. Accordingly, to use the razor 10, a user can grip and squeeze the U-shaped spring section 22 slightly, so as to decrease the distance between the blade retainer clamp 26 and the blade retainer clamp 27 from dimension "A" to dimension "B.".

This action positions the blade retainer clamps 26 and 27 for insertion through respective slots 32. Accordingly, when the user eases his grip on the U-shaped spring section 22, and the U-shaped spring section 22 springs back from the lessened grip, one slot 32 in the razor blade 14 may be snapped into the groove 28 of the blade retainer clamp 27 and the other slot 32 in the razor blade 14 may be snapped into the groove 28 of the blade retainer clamp 26.

Figure 3:
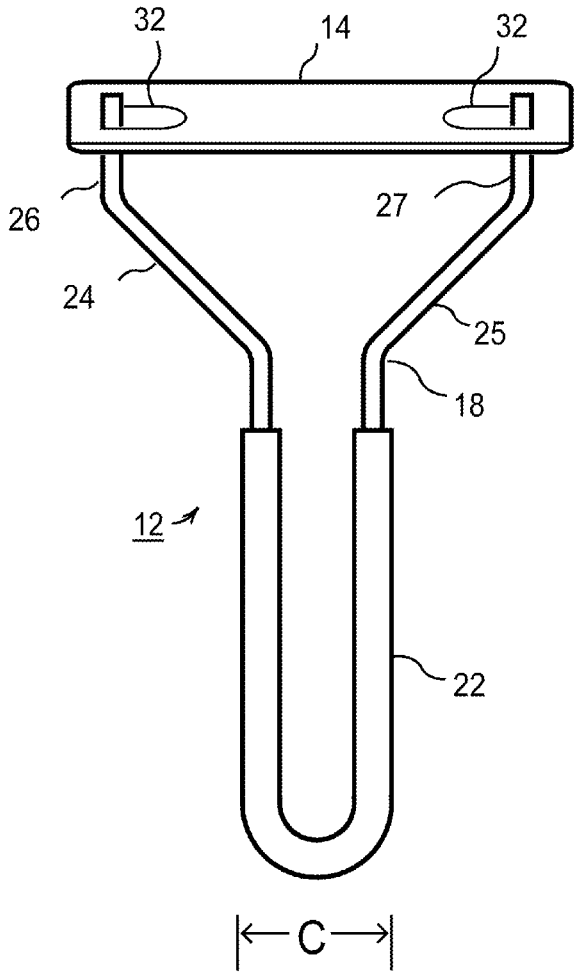
FIG. 3 is an assembled view of the razor of FIG. 1.

The razor blade 14 is thereby placed into tension and held securely by the outward forces exerted by the spring-action handle 12, which remains in a state of compression, in accordance with the present invention, as shown in FIG. 3. Moreover, the grooves 28 are skewed on the blade retainer clamp 26 and the blade retainer clamp 27 so as to orient and maintain the razor blade 14 at a predetermined angle "D" relative to the blade retainer clamps 26, 27, when the slots 32 are received by and snapped into the respective grooves 28.

Figure 4:
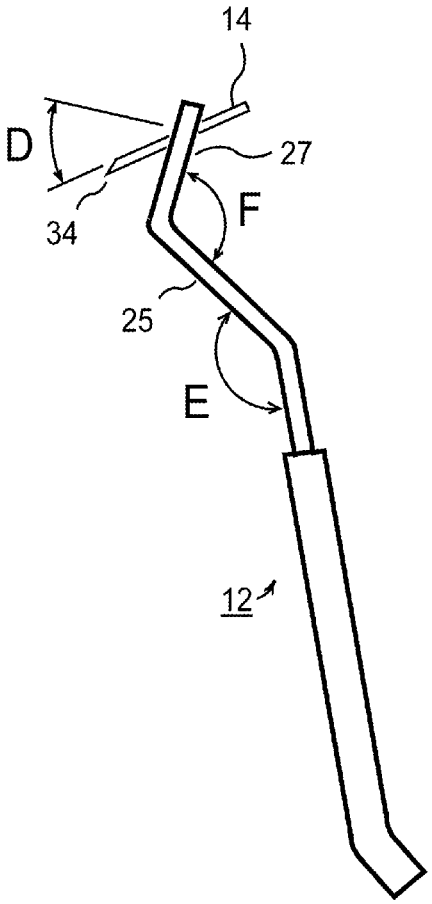
FIG. 4 is a side view of the razor of FIG. 3.

In an exemplary embodiment, the predetermined angle "D" may be approximately 45°, as shown in the side view of FIG. 4. This configuration places a razor blade cutting edge 34 at an optimal position for a user of the razor 10. In an exemplary embodiment, the razor blade 14 may be fabricated at low cost as the disclosed blade configuration requires a minimal amount of material for the razor blade 14.

Referring again to FIG. 3, the handle frame 18 includes transition arms 24, 25, each disposed at an obtuse angle to the U-shaped spring handle 22 so as to position the blade clamps 26, 27 at the dimension "A" shown in FIG. 1. In an exemplary embodiment, the overall length of the U-shaped spring handle may be about 100 mm, the lengths of the blade retainer clamps 26, 27 may be about 10 mm, and the width of the U-shaped spring handle 22, indicated by dimension "C," may be about 17 mm. The handle frame 18 may be formed from a heavy-gauge wire having a diameter of about 3.0 mm, with the groove 28 having a maximum depth of about 1.0 mm and a width of about 0.5 mm.

As best shown in the side view of the spring-action razor handle 12 in FIG. 4, the transition arms 24, 25 form an obtuse angle "E" with the respective ends of the U-shaped spring section 22, and the blade retainer clamps 26, 27 form another obtuse angle "F" with the respective transition arms 24, 25. This configuration allows a user to hold the spring-action razor handle 12 when shaving, while allowing the razor blade 14 to access the face of the user at an optimal angle, without interference from the hand of the user.

Figure 5:
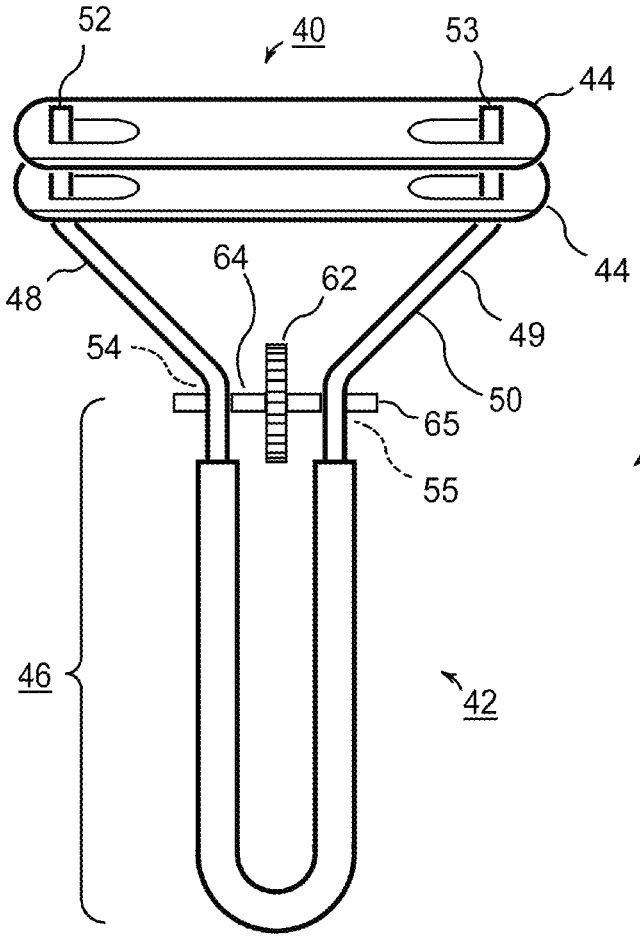
FIG. 5 is an alternate embodiment of the razor of FIG. 1 having a tension adjuster on the spring-action handle and two razor blades.
Figure 6:
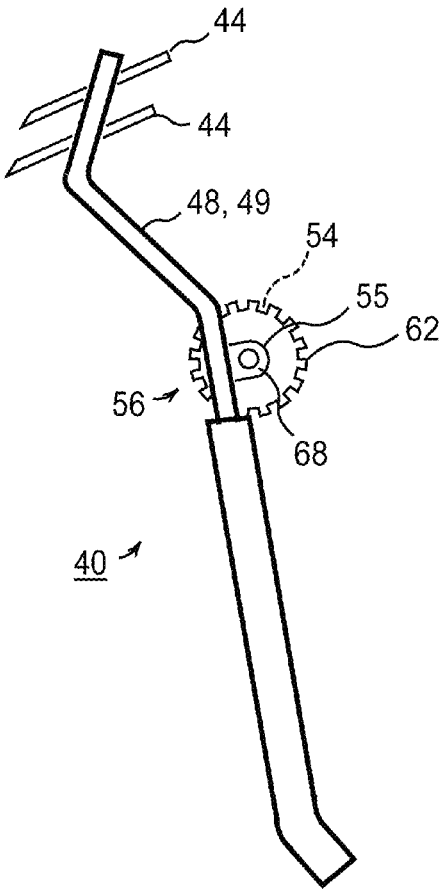
FIG. 6 is a side view of the razor of FIG. 5.

There is shown in FIG. 5 an exemplary of a razor 40 having adjustable tension means. The razor 40 comprises a spring-action razor handle 42 and a pair of razor blades 44, in accordance with the present invention. In the embodiment shown, the razor blades 44 have substantially rounded ends, with a radius of curvature of about 3.5 mm. The spring-action razor handle 42 includes a handle frame 50 having: (i) a U-shaped spring section 46, (ii) transition arms 48, 49 extending from respective ends of the U-shaped spring section 46, and (iii) blade retainer clamps 52, 53 extending from respective transition arms 48, 49. Each blade retainer clamp 52, 53 includes two grooves 28 (as shown in FIG. 2) to retain and position the razor blades 44 substantially as shown.

The arms of the U-shaped spring section 46 may include a first mounting tab 54 (hidden from view) and a second mounting tab 55 for securing a tension adjuster 56 to the razor 40. The tension adjuster 56 may include an adjustment wheel, such as a knurled wheel 62 having: (i) a first threaded stud 64 on one side of the knurled wheel 62 extending in a first direction along the wheel axis, and (ii) a second threaded stud 65 on the other side of the knurled wheel 62 extending in the opposite direction along the wheel axis. Preferably, one of the threaded studs 64, 65 has a left-hand thread, and the other of the threaded studs 65, 64 has a right-hand thread.

The tension adjuster 56 may be attached to the U-shaped spring section 46 by mating the threaded stud 64 with a threaded hole (not shown) in the mounting tab 54, and mating the threaded stud 65 with a threaded hole 68 in the mounting tab 55. By rotating the knurled wheel 62 clockwise or counter-clockwise, the user can adjust the tension to be placed by the U-shaped spring section 46 onto the blades 44. It should be understood that the design of the razor 40 is not limited to a tension adjustment configuration as shown, but may include any method known in the art of imparting a variable tension force onto the razor blade.

Figure 7:
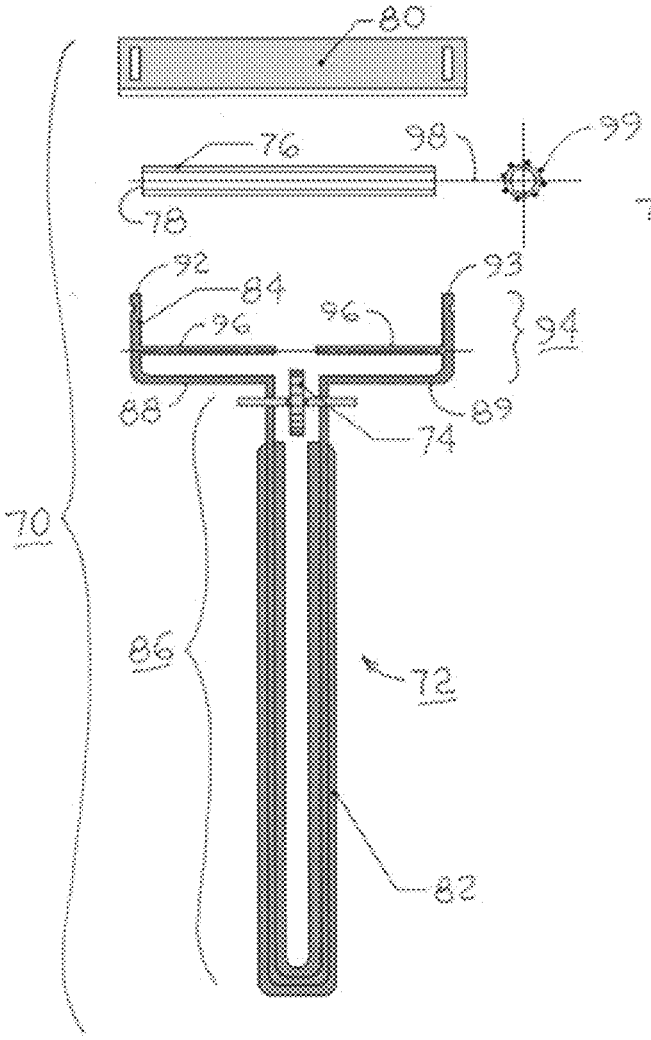
FIG. 7 is an exploded view of an alternate embodiment of the razor of FIG. 1 having a roller on the spring-action handle and one razor blade.
Figure 8:
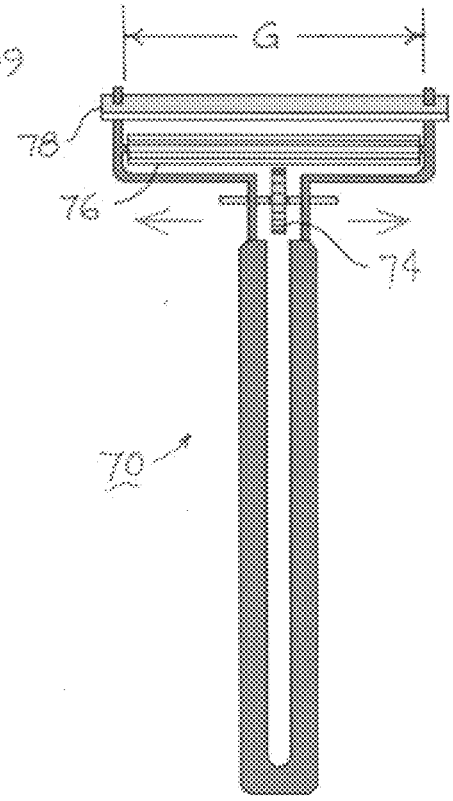
FIG. 8 is an assembled view of the razor of FIG. 7.

In an exemplary embodiment, shown in the exploded view of FIG. 7 and in the assembled view of FIG. 8, a razor 70 comprises a spring-action razor handle 72, a tension adjuster 74, a roller tube 76, and a razor blade 80, in accordance with the present invention. The roller tube 76 comprises a substantially cylindrical component formed from, for example, metal or plastic, and having an axial through hole 78. The roller tube 76 may thus function as a guide for the user of the razor blade 80. The spring-action razor handle 72 includes a handle sleeve 82 fabricated from a pliable or soft material, and disposed on a handle frame 84. The handle frame 84 comprises: (i) a U-shaped spring section 86, (ii) transition arms 88, 89 extending at approximately right angles from respective ends of the U-shaped spring section 86, and (iii) blade retainer clamps 92, 93 extending at approximately right angles from respective transition arms 88, 89.

The blade retainer clamps 92, 93 and the transition arms 88, 89 thus comprise a substantially U-shape blade/roller support 94. Each of the blade retainer clamps 92, 93 includes a roller support pin 96, each roller support pin 96 configured to fit into the through-hole 78 and thus align with a roller axis 98 when the roller tube 76 is secured in the razor 70, as best shown in FIG. 8. As can be appreciated by one skilled in the art, the overall length of the roller tube 76 is less than the dimension "G" such that, when the razor blade 80 is placed under tension by adjustment of the tension adjuster 74, the roller tube 76 is free to rotate on the roller support pins 96 as the outer surface of the roller tube 76 is moved against the face of a user. In an exemplary embodiment, the outer surface of the roller tube 76 includes a plurality of raised axial ridges 99 or other surface features that function to insure rotation of the roller tube 76 when the razor 70 is pulled along a user's face. This feature serves to improve gliding along the face surface to help improve quality of shaving.

Figure 9:
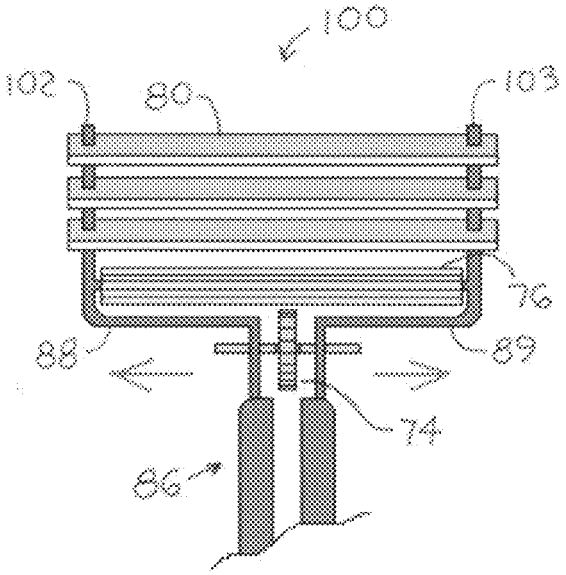
FIG. 9 is a view of an alternate embodiment of the razor of FIG. 8 having three razor blades.
Figure 10:
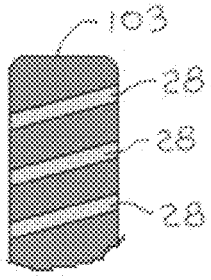
FIG. 10 is a detail side view of a blade retainer clamp of the razor of FIG. 9.

In an alternative embodiment, shown in FIG. 9, a razor 100 may comprise: (i) the U-shaped spring section 86, (ii) the tension adjuster 74, (iii) the transition arms 88, 89, (iv) the roller tube 76, (v) blade retainer clamps 102, 103 extending from respective transition arms 88, 89, and (vi) three razor blades 80, in accordance with the present invention. As can be seen in the partial side view of FIG. 10, the blade retainer clamp 103 includes three grooves positioned to retain the razor blades 80 at an optimal angle for shaving. The blade retainer clamp 102 is similarly configured.

Figure 11:
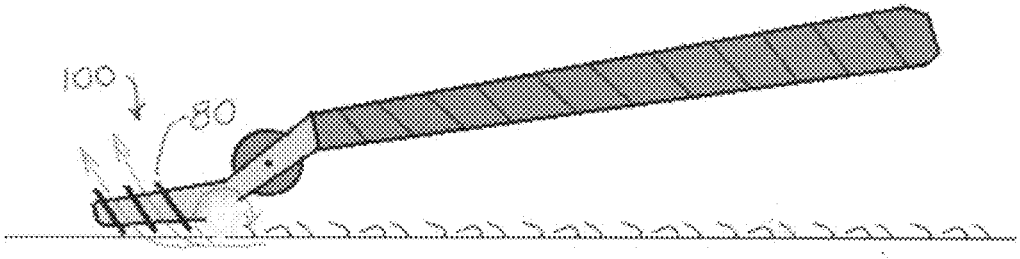
FIG. 11 is a side view of the razor of FIG. 9 showing a cleaning action.

As can be appreciated by one skilled in the art, blade cleaning is readily accomplished with the disclosed configuration in which the blades 80 are spaced apart and form openings which allows debris to pass through, or to be washed out of, the razor 100, as shown in FIG. 11. Moreover, an individual razor blade 80 can be removed for cleaning, or replacement, as the user may desire. In an alternative embodiment, any of the razor blades 14, 44, or 80 may be fabricated with two cutting edges, rather than with one, as shown in the illustrations. Accordingly, the user may remove one or more of the razor blades 14, 44, or 80, reverse the blade, and reinstall the blade into the respective spring-action razor handle 12, 42, or 72.

Figure 12:
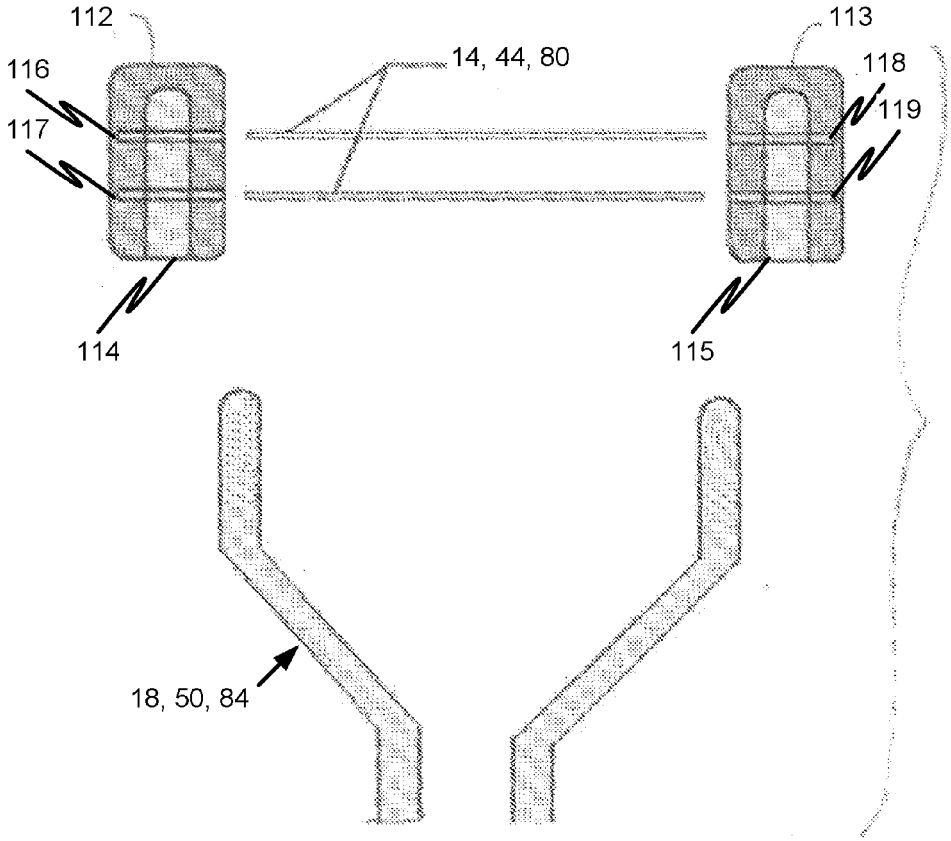
FIG. 12 is an exploded view of an alternate embodiment of the razors of FIGS. 1, 5, and 7 showing a handle frame, razors, and elastic end caps.
Figure 13:
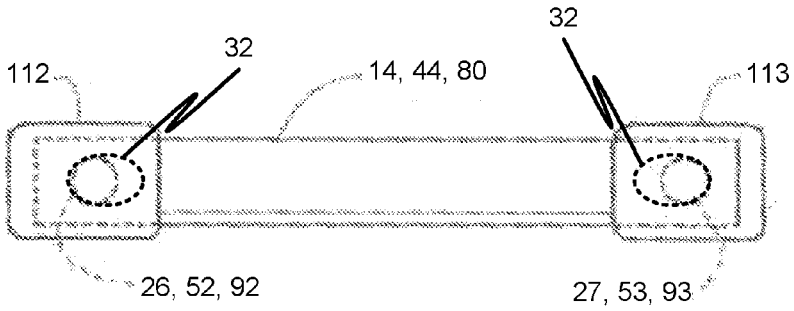
FIG. 13 is a top view of the razor of FIG. 12.

In an exemplary embodiment, any of the razors 10, 40, 70, and 100 described above can be modified with elastic end caps 112, 113 shown in FIG. 12. The elastic end caps 112, 113 each include a respective retention clamp hollow interior space 114, 115, as shown in FIG. 12. Also as shown in FIG. 12, each of the elastic ends caps 112, 113 includes respective blade grooves 116, 117, 118, 119. One or more of the razor blades 14, 44, 80 may be placed onto the handle frame 18, 50, or 84, and the elastic end caps 112, 113 can be placed over the blade retainer clamps 26, 27, 52, 53, 92, or 93 as shown in the top view of FIG. 13, so that the blade retainer clamps 26, 27, 52, 53, 92, or 93 fit into respective retention clamp hollow interior spaces 114, 115 and the ends of the blades slide into respective blade grooves 116, 117, 118, 119. The elastic end caps can be held in place by a friction fit caused by the elastic deformation once the blade retainer clamps and blades are in place in the elastic end caps 112, 113. In an exemplary embodiment, the elastic end caps may be fabricated from a soft plastic or a rubber-like material.

Figure 14:
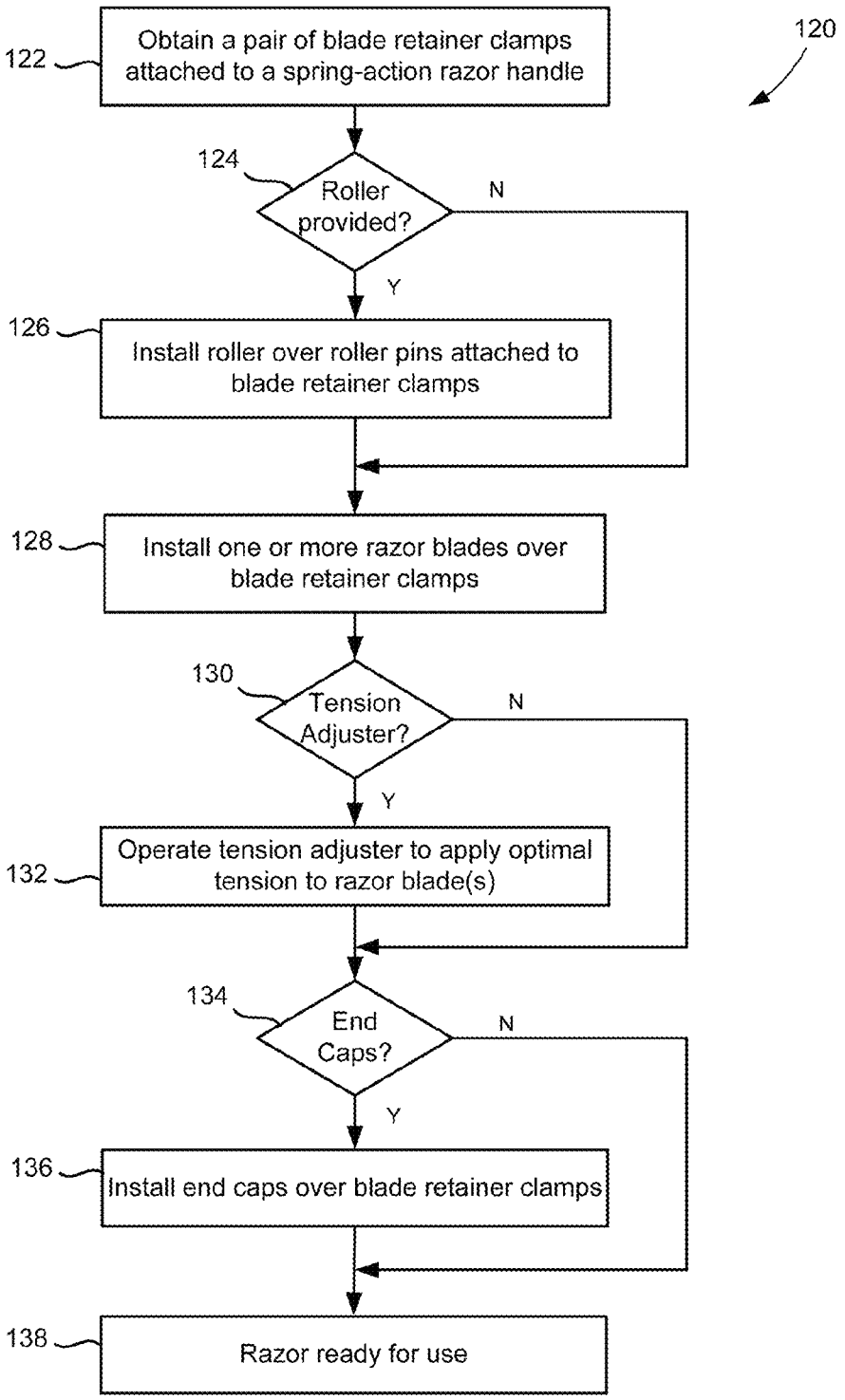
FIG. 14 is a flow diagram illustrating assembly and operation of the razors of FIGS. 1, 5, and 7.

Assembly and operation of any of the above-described razors 10, 40, 70, or 100 can be explained with reference to a flow diagram 120 in FIG. 14. A pair of blade retainer clamps 26, 27 or 52, 53, or 92, 93, are provided, attached to respective spring-action razor handle 22 or 42 or 72, at step 122. If the roller 76 is provided, at decision block 124, the roller may be installed over the roller pins 96, at step 126. At step 128, one or more razor blades 14, 44, or 80 are installed over the blade retainer clamps 26, 27 or 52, 53, or 92, 93.

If the tension adjuster 56 or 74 is provided, at decision block 130, the tension adjuster 56 or 74 is operated so as to apply optimal tension to the razor blades 14, 44, or 80, at step 132. If the elastic end caps 112, 113 are provided, at decision block 134, the elastic end caps 112, 113 are placed over respective blade retainer clamps 26, 27 or 52, 53, or 92, 93, at step 136. At this stage, the razor 10, 40, 70, or 100 is ready to provide a wet shave to a user.

It is to be understood that the description herein is exemplary of the invention only and is intended to provide an overview for the understanding of the nature and character of the invention as it is defined by the claims. The accompanying drawings are included to provide a further understanding of various features and embodiments of the method and apparatus of the invention which, together with their description serve to explain the principles and operation of the invention.

Thus, as stated above, while the invention has been described with reference to particular embodiments, it will be understood that the present invention is by no means limited to the particular constructions and methods herein disclosed and/or shown in the drawings, but also comprises any modifications or equivalents within the scope of the claims. Further, the purpose of the Abstract is to enable the U.S. Patent and Trademark Office, the public generally, and in particular practitioners in the art who are not familiar with patent or legal terms or phraseology, to determine from a cursory inspection the nature and essence of the technical disclosure of the application. Accordingly, the Abstract is not intended to define nor limit the claims in any way.

What is claimed is:

1. A razor suitable for providing a wet shave, said razor comprising:

a spring-action razor handle, said razor handle including:

a U-shaped spring section;

two transition arms, each said transition arm extending from a respective end of said U-shaped spring section;

two blade retention clamps, each said blade retention clamp including a groove and extending from a respective one of said transition arms;

at least one razor blade having two ends and two slots, each of the two slots respectively receiving one of the clamps in such a way that each of the grooves is in communication with a respective one of the slots thereby allowing for the spring action razor handle to maintain the at least one razor blade in a state of tension; and two elastic end caps each having a retention clamp hollow interior space and at least one blade groove, each of the two blade retention clamps are received by the retention clamp hollow interior space of a respective one of the elastic end caps and each of the two ends of the at least one razor blade are received by the at least one blade groove of a respective one of the elastic end caps.

2. The razor according to claim 1 wherein said U-shaped spring section comprises a handle sleeve, said handle sleeve fabricated from one of a plastic, rubber, or corrugated Cambric tube.

3. The razor according to claim 1 wherein at least one said transition arm forms an obtuse angle with said U-shaped spring section.

4. The razor according to claim 1 wherein at least one said blade retention clamp forms an obtuse angle with one of said transition arms.

5. The razor according to claim 1 further comprising a tension adjuster secured to said U-shaped spring section.

6. The razor according to claim 5 wherein said tension adjuster comprises a wheel, said wheel having a first threaded stud on one side of said wheel extending in a first direction along a wheel axis, and a second threaded stud on the other side of said wheel extending in the opposite direction along said wheel axis.

7. The razor according to claim 1, wherein said at least one razor blade is at a predetermined angle with respect to said at least one of said blade retention clamps.

8. The razor according to claim 1 wherein said spring-action razor handle and said two transition arms form a substantially Y-shaped configuration.

9. A razor handle suitable for securing at least one razor blade, said razor handle comprising:

a U-shaped spring section;

two transition arms, each said transition arm extending from a respective end of said U-shaped spring section;

two blade retention clamps, each said blade retention clamp extending from a respective one of said transition arms, each said blade retention clamp including at least one groove for securing at least one razor blade by insertion of said blade retention clamp into a slot in said at least one razor blade, whereby said razor handle maintains a state of compression so as to place said at least one razor blade into a state of tension; and two elastic end caps each having a retention clamp hollow interior space and at least one blade groove, each of said two blade retention clamps are received by said retention clamp hollow interior space of a respective one of said elastic end caps and said at least one blade groove of each of the elastic end caps are each configured to receive respective ends of said at least one razor blade.

10. The razor handle according to claim 9 wherein said at least one groove is oriented so at to maintain the razor blade at a predetermined angle with respect to a respective said blade retention clamp.

11. The razor handle according to claim 9 further comprising a handle sleeve, said handle sleeve fabricated from one of a plastic, rubber, or corrugated cambric tube.

12. The razor handle according to claim 9 further comprising a roller tube disposed between said two blade retention clamps.

13. The razor handle according to claim 9 further comprising a tension adjuster secured to said U-shaped spring section.

* * * * *